US005346226A

United States Patent [19]

Block

[11] Patent Number: 5,346,226

[45] Date of Patent: Sep. 13, 1994

[54] RESET TARGET SYSTEM

[75] Inventor: James E. Block, Franklin, Mo.

[73] Assignee: Shotstop Target Systems, Inc., Union, Mo.

[21] Appl. No.: 132,883

[22] Filed: Oct. 7, 1993

[51] Int. Cl.[5] ..... F41J 7/04

[52] U.S. Cl. ..... 273/388; 273/392; 273/407

[58] Field of Search ..... 273/392, 391, 388, 407

[56] References Cited

U.S. PATENT DOCUMENTS

| | | | |
|---|---|---|---|
| 1,348,540 | 8/1920 | Briggs | 273/388 |
| 1,424,632 | 8/1922 | Fenton | 273/392 |
| 1,845,609 | 2/1932 | Knipper | 273/388 |
| 2,085,993 | 7/1937 | Vaughan | 273/388 |
| 2,561,733 | 7/1951 | Foyst | 273/388 |
| 3,411,784 | 11/1968 | Lawrence | 273/388 |
| 3,542,365 | 11/1970 | Gantz | 273/407 |
| 4,726,593 | 2/1988 | Wade | 273/392 |
| 4,917,388 | 4/1990 | Marquardt | 273/392 |

*Primary Examiner*—William H. Grieb
*Attorney, Agent, or Firm*—Paul M. Denk

[57] ABSTRACT

A resetting target assembly having a frame designed to rest on a flat surface, two upright supports extending up from the base, and a crossmember between the uprights with a pair of targets substantially aligned thereon. The targets are cooperatively connected by a linkage so that the falling of the first target, when struck by a projectile, raises the second target from a horizontal to a vertical position. The falling of the second target, when struck by a projectile raises the first target from a horizontal to a vertical position.

5 Claims, 2 Drawing Sheets

RESET TARGET SYSTEM

BACKGROUND OF THE INVENTION

This invention relates to a target device for pistol or rifle practice, more particularly, to a device in which the striking of a first target with a projectile resets a second target in the line of fire and vise-versa.

Targets for pistol or rifle practice are well known to the art. Often, these targets are simply fixed paper or cardboard sheets having a design, such as the well known concentric circle surrounding a "bulls-eye" or, a stationary figure such as the silhouette of a criminal or the silhouette of a game animal such as a deer or bear.

In some situations the use of the stationary paper or cardboard targets and the like are not satisfactory since they require removal and viewing to determine a strike by a bullet or projectile or they require that the marksman walk from the shooting station to the target to inspect the target for strikes. If the shooter is a long distance from the target, it is inconvenient and time consuming for the shooter to walk to the target and inspect the target for results. Moreover, if there is one or more marksman shooting, for example, at a firing range or target range, it would be too dangerous for any one marksman to walk toward the target area while the others are still shooting. The shooters must wait until all have finished the round of practice before inspecting the target.

Furthermore, it is beneficial to the marksman to know immediately if he or she has struck the target. This allows for better practice, since immediate feedback helps the shooter improve his or her technique. To that end, the shooters desire to use targets that indicate immediately that the target has been struck. The crudest form of such target would be a bottle or can placed at one end of a shooting range. The shooter can tell immediately if the bottle or can has been struck. More sophisticated targets employing this principal may be used. However, these types of targets have other obvious drawbacks. Once the shooter hits this type of target, perhaps a clay target or some other target which is destroyed upon impact of a projectile, it is obviously broken or destroyed, it can fall over, or be knocked out of the shooter's sight. The marksman must continually replace this type of target during practice session.

To avoid this problem, inventors have developed various types of "resetting" targets. For example, U.S. Pat. No. 1,348,540 to Briggs provides for an automatic safety target. However, these targets are necessarily small and must be placed at close range or in protective boxes. Furthermore, the reset targets are generally side-by-side and require that the shooter change his or her line of fire from side-to-side depending upon how the target is reset.

U.S. Pat. No. 1,424,632 to Fenton provides a rotating target for small arms practice. The targets rotate as they are struck by a projectile. The device is somewhat complex, has a plurality of moving parts, and appears to provide a resetting target that can appear on a slant or angle (Col. 1, lines 20–22), which can be difficult for the shooter to hit.

U.S. Pat. No. 1,845,609 to Knipper provides another complex reappearing target device having a plurality of moving parts and an intricate mechanism. Likewise, U.S. Pat. No. 2,561,733 to Foyst requires a meshing gear mechanism and also requires the shooter to swing his or her line of fire to side-to-side to hit the reappearing targets.

U.S. Pat. Nos. 2,085,993 to Vaughan, 4,917,388 to Marquardt, 3,411,784 to Lawerence, and 4,726,593 to Wade all provide simple mechanisms that allow the individual targets to swing and move when struck by a projectile indicating a successful shot, yet, pivot back into position or swing back into position for another shot. These devices also have notable drawbacks. First, the targets are arranged side-by-side such that they require the shooter to move his or her line of fire from side-to-side to hit the target. Moreover, the shooter must wait for the target to stop swinging and properly align itself before taking another shot. This does not lend itself to practice of rapid fire marksmanship.

SUMMARY OF THE INVENTION

It is, therefore, a principal object of the present invention to provide a resetting target assembly for firearms practice having a pair of cooperatively attached and substantially aligned targets in which the falling of the first target resets the second target by raising it from a horizontal position to a vertical position and vise-versa.

Another object of the invention is to provide a resetting target assembly for firearms practice wherein the two substantially aligned targets are interconnected by a simple linkage system that translates the falling motion of one target into the rising motion of the other target.

Still another object of the present invention is to provide a resetting target assembly in which two cooperating targets are substantially aligned so that the marksman does not have to change line of fire when shooting at the alternating targets.

Yet another object of the present invention is to provide a resetting target assembly that will indicate with certainty whether or not the particular target aimed at was hit.

A further object of the invention is to provide a resetting target assembly that is of simple and practical construction, durable and reliable in operation, relatively inexpensive to manufacture and otherwise well suited for its intended purposes.

Briefly stated, a resetting target assembly is provided having a general "H"-shaped frame designed to rest on a flat surface, two upright supports extending up from the base, and a cross member between the uprights, the cross member having a pair of target plates substantially aligned thereon, the target plates cooperatively connected by a linkage means so that the falling of the first target, when struck by a projectile, raises the second target from a horizontal to a vertical position, and, correspondingly the falling of the second target when struck by a projectile raises the first target from a horizontal to a vertical position to be fired upon.

DESCRIPTION OF THE PREFERRED EMBODIMENT

Figure 1:
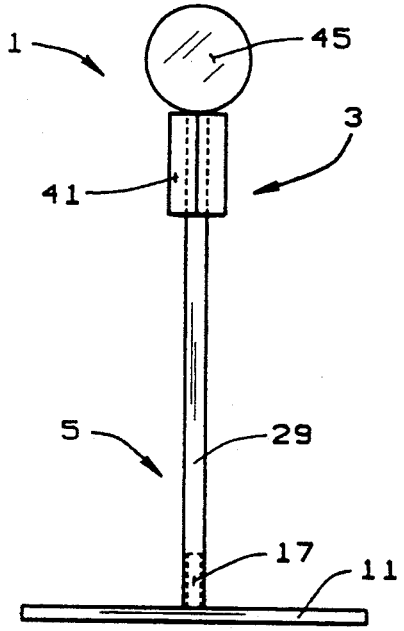
FIG. 1 is a front elevation of the reset target system of the present invention.
Figure 2:
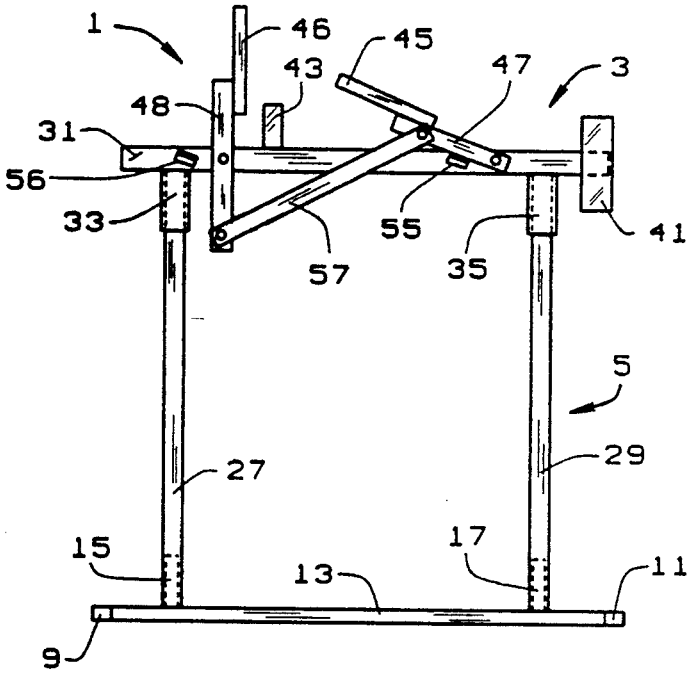
FIG. 2 is a side elevation of the reset target of the system of the present invention.

The reset target system of the present invention is indicated generally by reference numeral 1 in FIGS. 1 and 2. The reset target system 1 is comprised of two major structural assemblies, the target and linkage assembly shown generally at 3 and the frame assembly 5.

Figure 3:
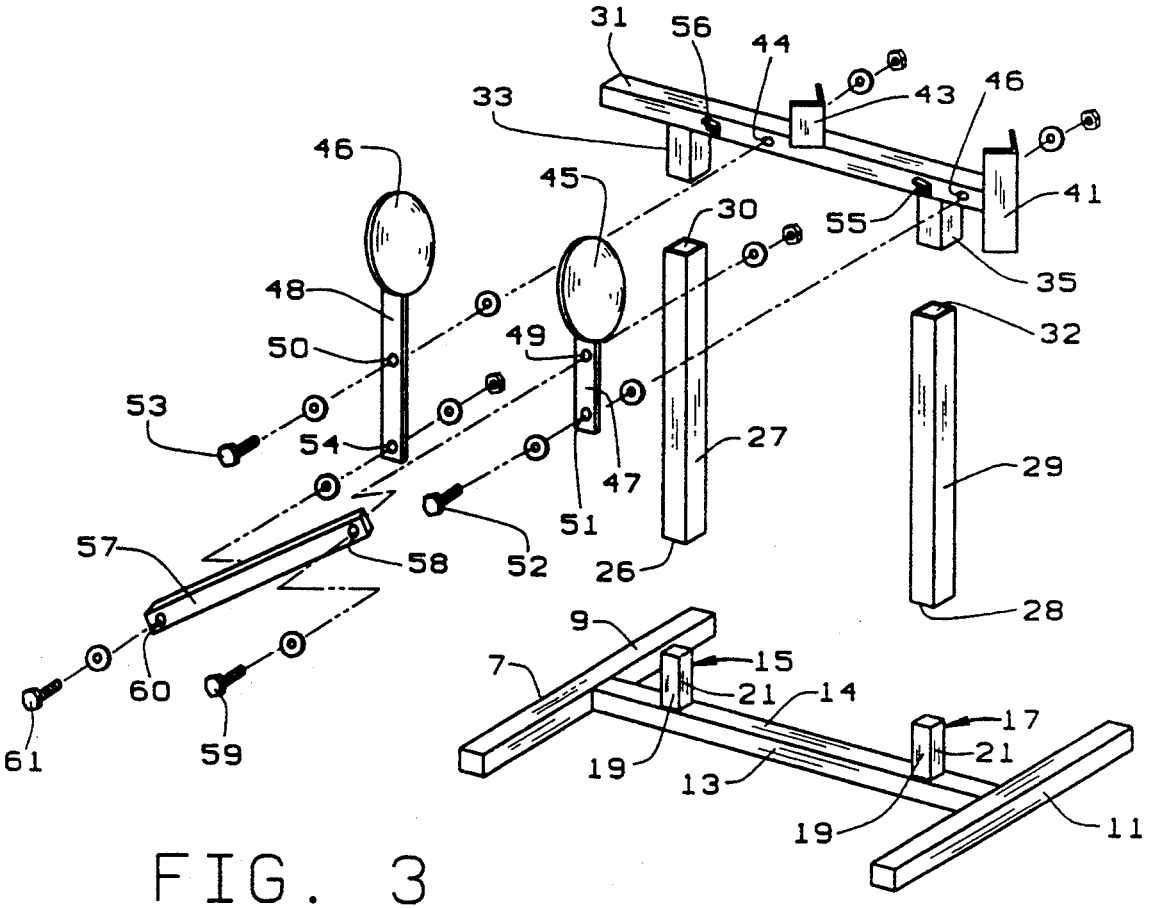
FIG. 3 is an exploded view of the reset target system of the present invention.

The frame assembly 5 of the reset target system of the present invention is best illustrated at FIGS. 1–3. The frame assembly 5 consists, in the preferred embodiment, of a generally "H" shaped frame 7 having two opposed elongated base members 9, 11 connected by horizontal brace member 13 interposed between bar members 9 and 11. Members 9, 11, and 13 are all formed from square tubing, made from a suitable material such a lightweight steel. In the preferred embodiment, the frame members 9, 11 and 13 are welded together to form a base assembly 5. It should be noted that the members 9, 11 and 13 may be joined in any appropriate manner, such as bolts, metal screws, or the like.

Two upright posts, 15 and 17, are formed on an upper surface 14 of brace member 13. Opposed walls, as at 19 and 21, form the generally rectangular boxlike posts 15, 17, sized to allow the uprights 27 and 29 to slide thereover. Uprights 27 and 29 are also made of square tubing and are oversized slightly to seat on posts 15 and 17 so they fit snuggly. Although, it is just as likely that posts 15, 17 could be sized to accommodate the mounting insertions of members 27, 29 therein.

Figure 4:
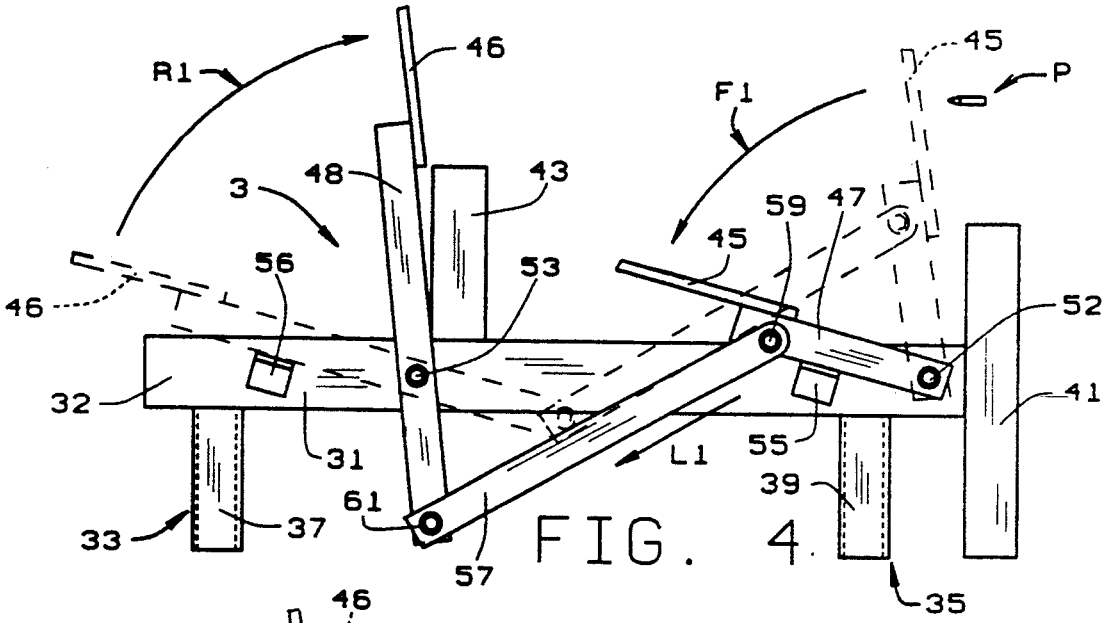
FIG. 4 is a side elevation of the target and linkage elements of the reset target system of the present invention showing the second target being reset to a vertical position.
Figure 5:
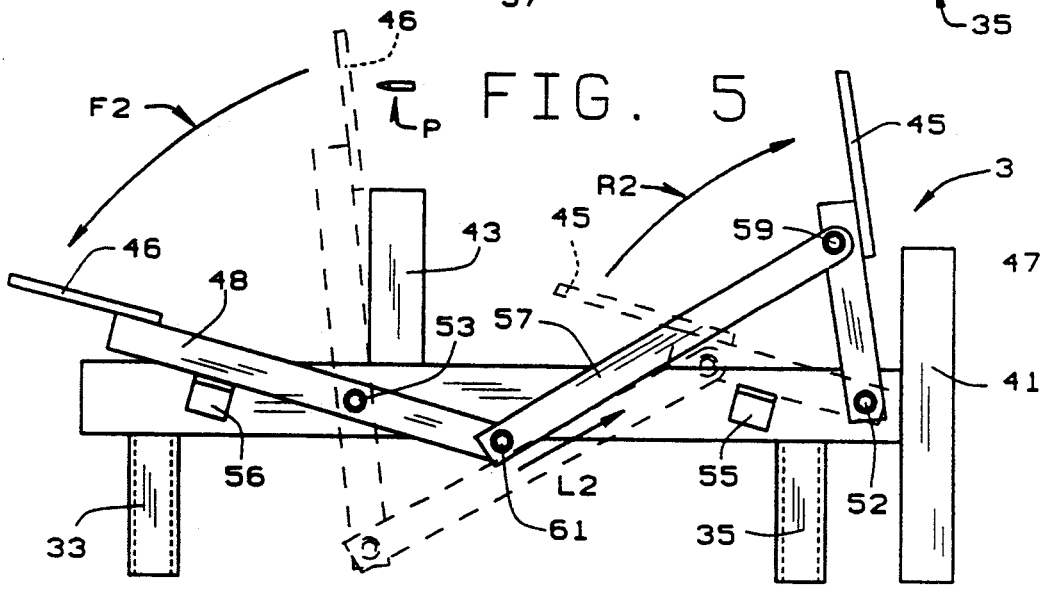
FIG. 5 is a side elevation view of the target and linkage assembly of the present invention of the reset target system of the present invention showing the first target being reset to a vertical position.

Turning now to the target and linkage assembly 3 best illustrated in FIGS. 3–5. Assembly 3 has horizontal main channel 31 which is a U-shaped channel made of steel or other appropriate material. A pair of downwardly extending sleeves 33 and 35 are attached in channel 31 by welding or other appropriate attachment means and have generally square walls 37 and 39 defining chambers (not shown) which are sized to fit over ends 30 and 32 of vertical members 27 and 29 respectively. Although, the sizing of members 33, 35 to fit within members 27 and 29 could just as equivalently be done.

A first V-shaped angled deflector 41 (see FIG. 3) made of a resistant alloy such as a hard steel alloy is mounted on the forward end of channel 31. A second V-shaped angle deflector 43 FIG. 3 made from a resistant alloy is mounted on channel 31 at about the midpoint.

A first target plate 45 welded or appropriately attached to shank 47 is pivotally attached to channel 31 by a nut and washer bolt assembly 52 inserted through hole 51 formed in shank 47 and through hole 46 formed in channel 31. A second target plate 46, welded or appropriately attached to the shank 48 is pivotally attached to channel 31 by a nut and washer bolt assembly 53 inserted through hole 50 formed in shank 48 and hole 44 formed in channel 31. It should be noted that shank 48 is approximately 50 to 55% longer than shank 47. It should also be noted that target plate 45 and 46 are of approximately the same size and mass. Plates 45 and 46 are in substantial alignment as channel 31. Plates 45 and 46 are made of a specific alloy such as a steel alloy designed to withstand impact and abrasion. Shanks 47 and 48 as well as channel 31 may be made from the same alloy. Such an alloy may be an armor plate such as Wearalloy AR 500, available from Ford Steel of St. Louis, Mo. It should be noted, however, that any appropriate material, metal, or alloy is within the scope or the appended claims.

Stops 55 and 56 are welded onto and extend outward from side 32 of channel 31. A linkage member 57 is attached at one end to shank 47 proximate target 45 with nut-washer bolt assembly 59 inserted through hole 58 formed in one end of the member 57 and through pivotal hole 49 formed in shank 47. Linkage member 57 is attached at the opposite end with bolt-washer and nut assembly 61 inserted through hole 60 formed in member 57 and through hole 54 formed in shank 48.

FIGS. 4 and 5 illustrate the relationship of the above-described elements of the linkage assemble in use. FIG. 4 shows the relative position of the elements of the target when the first target plate 45 is struck by a projectile P. First target plate 45 falls under the force of projectile P as shown by arrow F and comes to rest on stop 55. The falling movement of target plate 45 applies a downward leverage force, shown as arrow L1, en linkage member 57 which is transferred to shank 48 creating a rising motion of second target plate 46, as shown by arrow $R_1$. The second target plate 46 is reset in the same axial line as the fallen target plate 45.

FIG. 5 illustrates the relative movement of the previously described elements when second target plate 46 is struck by projectile P. Second target plate 46 falls coming to rest on stop 56. The falling motion of plate 46, shown as $F_2$, causes leverage motion, shown as arrow $L_2$, on linkage member 57 which causes first target plate 45 to rise, as shown by arrow $R_2$.

It should be noted at this point the degree of tightness or the amount of tension on the bolt-washer and nut assemblies 52, 53, 59 and 61 can be adjusted as required to facilitate the proper functioning of the reset system based upon the projectile energy. Furthermore, the target system is designed to withstand repeated impacts at various energy levels with the minimal aware or need for repairs. It should be further noted that the target system can employ different size or shaped target plates 45 and 46 depending upon the caliber of bullet fired at the target. The reset target system of the present invention can be assembled or disassembled in a short time, is compact for storage, and relatively light weight.

Figure 6:
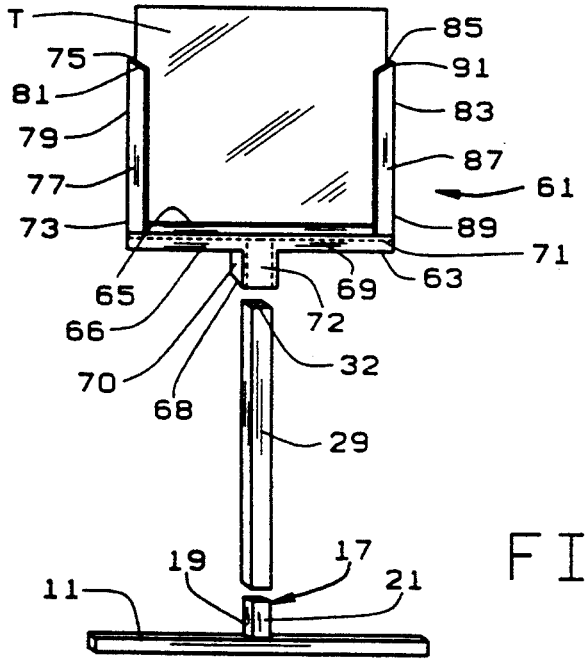
FIG. 6 is an alternative embodiment of paper holding target accessory to be mounted on the frame member of the reset target system of the present invention.

FIG. 6 illustrates an alternative member attachable to an upright vertical member, such as 29, to enhance the functionality of the previously described target device. This alternative member has a generally U-shaped frame 61 with a horizontal lower edge 63. Edge 63 is comprised of opposed walls 65 and 66 joined along an edge 69 to define a V-shaped opening 71. Edge 63 has a square sleeve 68 having four opposed walls as at 70 which define chamber 72 sized to slide into or over end 32 of vertical member 29, to provide for its mount.

A pair of opposed vertical edges 73 and 83 are attached to and extend up from horizontal edge 63. Edge 73 is formed from a pair of opposed walls 75 and 77 joined at an edge 79 to define V-shaped opening 81. Edge 83 is a mirror image of edge 73 comprised of opposed walls 85 and 87 joined at edge 89 to define a V-shaped opening 91. A paper target T fits within V-shape openings 71, 81 and 91.

These modifications and changes in the target of the present invention may be made without departing from the spirit and scope of the invention as provided in the appended claims. Therefore, the foregoing description of the preferred embodiment as well as the accompanying drawings are intended to be illustrative and to be construed in a limiting sense.

I claim:

1. A resetting target assembly for pistol or rifle target practice comprising:

an upright frame for supporting the target assembly;

a cross member on said upright support frame;

a first target plate and a second target plate, substantially longitudinally aligned on said cross member, the second target plate being arranged substantially behind the first target plate;

a linkage means cooperatively connecting said first target plate and said target plate capable of translating falling energy generated by said first plate when said first plate is struck by a projectile to raise the second target plate from a horizontal position to a vertical position, and correspondingly, to translate falling energy of said second plate generated when said second plate is struck by a projectile to raise said first target plate from a horizontal to a vertical position; and a first shank pivotally mounting said first target plate to said cross member, and a second shank pivotally mounting said second target plate to said cross member, and said linkage means interconnecting between said first and second shanks, said second shank being longer than said first shank, to facilitate the usage of the energy generated when said first and second target plates are struck by a projectile to provide a raising of one of said plates from a horizontal to a vertical position for resetting of a target for practice.

2. The invention of claim 1 wherein said linkage means can be adjusted to allow proper functioning of said linkage system according to the projectile energy absorbed by said targets.

3. The invention of claim 1 wherein said first target plate and said second target plate are approximately the same size and mass.

4. The invention of claim 3 wherein each said target plate is made from a steel alloy so as to withstand the impact of a projectile.

5. A resetting target assembly comprising:

a generally "H"-shaped base frame for resting on a flat surface;

a pair of opposed upright members extending upward from said base frame;

a cross member attached between said pair of opposed upright members;

a first and second target plate of approximately the same size and mass substantially aligned and pivotally attached to said cross member; and a linkage means cooperatively connecting said first and second target plates capable of translating a falling motion of said first target when struck by a projectile into a rising motion of said second target plate to move said second target plate from a horizontal to a vertical position and capable of translating a falling motion of said second target plate when struck by a projectile into a rising motion of said first target plate to move said first target plate from a horizontal to a vertical position.

* * * * *

UNITED STATES PATENT AND TRADEMARK OFFICE

CERTIFICATE OF CORRECTION

PATENT NO. : 5,346,226

DATED : September 13, 1994

INVENTOR(S) : James E. Block

It is certified that error appears in the above-identified patent and that said Letters Patent is hereby corrected as shown below:

On the title page: Item[75]

change inventor's residence from "Franklin, Mo." to ---Union, Mo.---.

Signed and Sealed this

Tenth Day of January, 1995

*Attest:*

*Attesting Officer*

Bruce Lehman

BRUCE LEHMAN

*Commissioner of Patents and Trademarks*